US009457930B1

(12) United States Patent
Stengel, Jr. et al.

(10) Patent No.: US 9,457,930 B1
(45) Date of Patent: Oct. 4, 2016

(54) FLIP-UP POP-TOP CAN LID

(75) Inventors: Gilbert P. Stengel, Jr., Burlington, KY (US); Francis C. Ganance, Cincinnati, OH (US); Tracey Schieman, Waynesville, OH (US)

(73) Assignee: FGT TOP LLC, Burlington, KY (US)

( * ) Notice: Subject to any disclaimer, the term of this patent is extended or adjusted under 35 U.S.C. 154(b) by 489 days.

(21) Appl. No.: 13/554,598

(22) Filed: Jul. 20, 2012

Related U.S. Application Data

(60) Provisional application No. 61/510,714, filed on Jul. 22, 2011.

(51) Int. Cl.
*B21D 51/38* (2006.01)
*B65D 17/00* (2006.01)

(52) U.S. Cl.
CPC ..... *B65D 17/16* (2013.01); *B21D 51/38* (2013.01)

(58) Field of Classification Search
CPC B65D 17/165; B65D 17/163; B65D 17/161; B65D 17/16; B21D 51/383; B21D 51/38
USPC ..... 53/492; 220/906, 272, 271, 270, 269, 220/268, 266, 265; 413/17, 16, 15, 14, 12
See application file for complete search history.

(56) References Cited

U.S. PATENT DOCUMENTS

| | | | | |
|---|---|---|---|---|
| 3,556,336 | A * | 1/1971 | Jackie | 215/255 |
| 4,681,238 | A * | 7/1987 | Sanchez | 220/260 |
| 4,901,877 | A * | 2/1990 | Hall | 220/703 |
| 5,145,086 | A * | 9/1992 | Krause | 220/270 |
| 5,443,174 | A * | 8/1995 | Bauer | 220/212 |
| 5,775,534 | A * | 7/1998 | Webb et al. | 220/269 |
| 6,290,084 | B1 * | 9/2001 | Louie | 220/254.4 |
| 6,450,359 | B1 * | 9/2002 | Chang et al. | 220/269 |
| 2002/0088802 | A1 * | 7/2002 | DeRose | 220/258.2 |
| 2009/0200304 | A1 * | 8/2009 | Wendle | 220/260 |
| 2010/0025402 | A1 * | 2/2010 | Hoffman et al. | 220/270 |
| 2011/0232423 | A1 * | 9/2011 | Raymond | 81/3.09 |
| 2012/0248113 | A1 * | 10/2012 | Majcen et al. | 220/269 |
| 2013/0221005 | A1 * | 8/2013 | Raymond | 220/212 |

* cited by examiner

*Primary Examiner* — Andrew M Tecco
*Assistant Examiner* — Praachi M Pathak
(74) *Attorney, Agent, or Firm* — Jenei LLC

(57) ABSTRACT

A flip-up pop-tab in which a partially detachable portion of a lid of a can is separated from the can and hinged away from the opening created in the lid is described.

17 Claims, 5 Drawing Sheets

FLIP-UP POP-TOP CAN LID

CROSS-REFERENCE TO RELATED APPLICATION

This application claims the benefit of U.S. Provisional Application No. 61/510,714, filed Jul. 22, 2011.

BACKGROUND ON THE INVENTION

1. Field of the Invention

The present invention relates generally to cans, and more particularly, to pop-top cans having a panel that lifts upward away from the associated can.

2. Description of the Related Art

Pop-top cans are popular containers for a variety of food products and beverages. The vast majority of canned beverages such as, for example, soft drinks, beer, juices, and the like, are opened via a top-pop opening in the top of the can. Pop-top cans can also be used to hold a variety of other products, such as car products, lawn care products, and the like.

Typical pop-top cans include a tab riveted to atop of a cylindrical can, most often near the center of the top. As the tab is pulled upward on one end, the opposing end is directed downward towards a scored region of the top of the can. When enough force is exerted by the tab against the scored region, the scored region begins to separate from the rest of the top of the can, thereby creating an opening through which contained beverages may be consumed.

Although there has been great commercial success, there are significant drawbacks to the current pop-top can. The tabs on most pop-top cans are substantially flat against the top of the can. Lifting the tab upward and away from the top of the can be an arduous task for individuals with arthritis, longer fingernails, thick or larger fingers, and the like. Furthermore, because the above-described scored region is directed downward, into the can, the region can potentially come into direct contact with the contained beverage or foodstuff. This can be unsanitary and unhealthy.

Thus, what is a desired is a pop-top can that can safely be opened by lifting a region of the top of the can in an upward direction.

SUMMARY

Various embodiments include a pop-top including a lid having a panel outlined via a score line, a puncturing means connected to the lid and adjacent to the partially detachable portion, and an opening means attached to the partially detachable portion. The opening means can include a lever arm and a panel cover connecting around a rivet opening.

In various embodiments, a can is opened by lifting the lever arm of the opening means near perpendicular, relative to the lid and detaching the panel of the lid. Then, the lever arm is lifted to fold forward towards the lid. Stress relief around the panel cover allows the panel cover to remain substantially in a plane with the lid, even though the panel partially separates from the lid. The panel is lifted to be adjacent to the panel cover away from the lid.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Various embodiments are described in the following detailed description in conjunction with the accompanying drawings, in which.

DESCRIPTION OF THE REFERENCED NUMERALS

Figure 1:
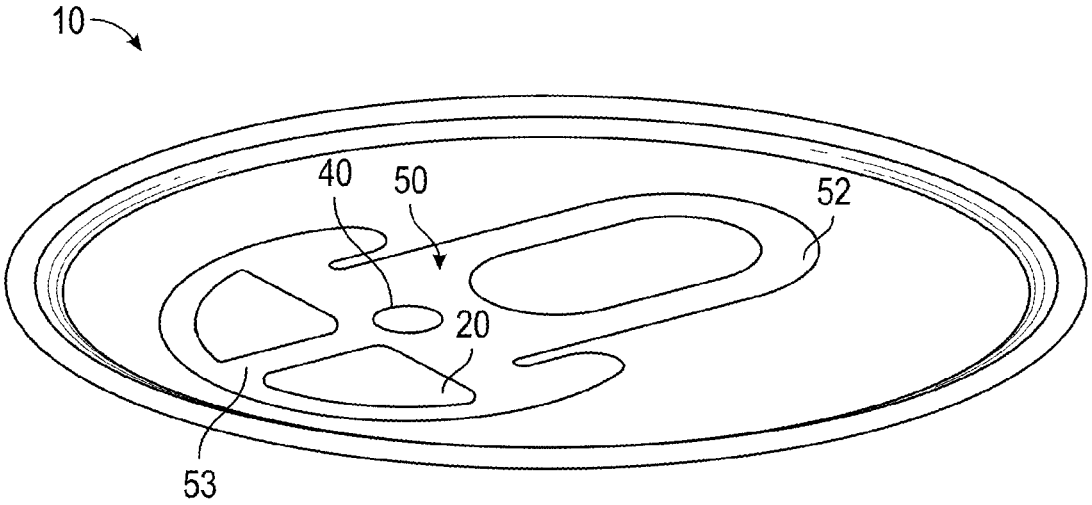
FIG. 1 is a top-view illustration of a lid in a fully-sealed position having a panel in accordance with one or more embodiments.

In reference to the drawings, similar reference characters denote similar elements throughout all the drawings. The following is a list of the reference characters and associated element:

10 lid
20 panel
30 score line
31 first score line end
32 second score line end
40 rivet
50 opening means
52 lever arm
53 panel cover
54 rivet opening
55 arm
56 opening
57 elongated parallel side
58 curved end

DETAILED DESCRIPTION

FIG. 1 is a top-view illustration of a lid 10 in a fully-sealed position having a panel in accordance with one or more embodiments. As shown in FIG. 1, an opening means 50 is attached to lid 10 via a rivet 40. The opening means includes a lever arm 52 and a panel cover 53. While FIG. 1 illustrates the use of a rivet to attach the opening means 50 to the lid 10, the opening means can be attached to the lid using adhesives or the like as an alternative to the rivet. The opening means is able to rotate around the rivet if needed, although the opening means in FIG. 1 is shown oriented such that the panel cover 53 is adjacent to (and covers) a panel 20 of the lid. The rivet may be located anywhere on the lid, and need not be centralized on the lid relative to the edges of the lid 10.

Figure 2:
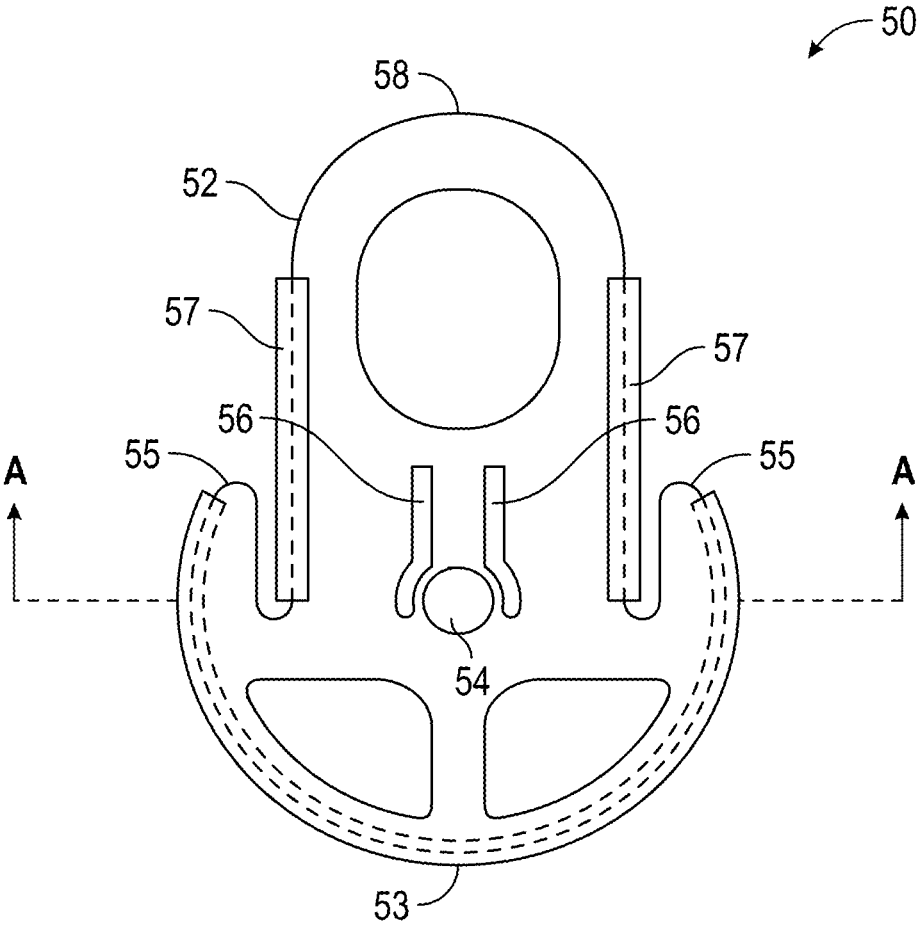
FIG. 2 is a top view illustration of an opening means in accordance with one or more embodiments.

FIG. 2 illustrates an opening means in accordance with one or more embodiments. As shown in FIG. 2, the lever arm 52 and panel cover 53 are joined substantially around a rivet opening 54. The opening means 50 may be manufactured from plastic, metal, ceramic, or a combination thereof. Other materials can be used, depending on the specific embodiment.

The lever arm 52 may be of any shape such that an individual's finger, individual's fingernail, or other edged tool may pry and separate a bottom side of the lever arm from being substantially adjacent to the lid.

In the embodiment illustrated, the lever arm has two elongated parallel sides 57 connected at one end to the panel cover of the opening means, and connected at the opposing end by a curved end 58. In some embodiments, curved end 58 has a semi-circular shape. It is the curved end that is preferably used to pry and separate a bottom side of the lever arm 52 from the adjacent lid. In some embodiments, the lever arm 52 is substantially planar and includes one or more openings 56.

The openings 56 are configured to relieve stress from the lever arm 52 as it is utilized to open the lid, as well as to reduce stress near the rivet opening. In particular, the openings 56 can reduce the forces applied to the center of the opening means 50 and can prevent the opening means from being detached from the lid.

The panel cover 53 of the opening means can be any shape, provided it substantially corresponds to and/or mirrors the shape of the score line of the panel. For example, as shown in FIG. 1, the panel cover of the opening means is semi-circular in shape and shaped to substantially mimic a majority of the overall shape of the panel of the lid. In various embodiments, the panel cover is sized to be just slightly larger than the overall shape of the panel. In some embodiments, the panel cover is substantially planar and includes one or more openings.

In various embodiments, the panel cover of the opening means is substantially circular in shape, such that the overall shape forms a semi-circular shape greater than 180 degrees. The panel cover includes one or more arms 55 that extend in a direction parallel to the elongated parallel sides 57 of the lever arm. Each arm 55 of the panel cover is separated from the adjacent elongated side of the lever arm by a bend relief portion. In various embodiments, the panel cover has two arms 55, one being adjacent and parallel to each elongated parallel side 57 of the panel cover. The arms 55 are configured such that they apply pressure to the lid rather than the panel of the lid when the opening means is engaged. In other words, the alms are positioned to apply force to the lid outside the score line, where the portion inside the score line constitutes the panel.

Figure 3:
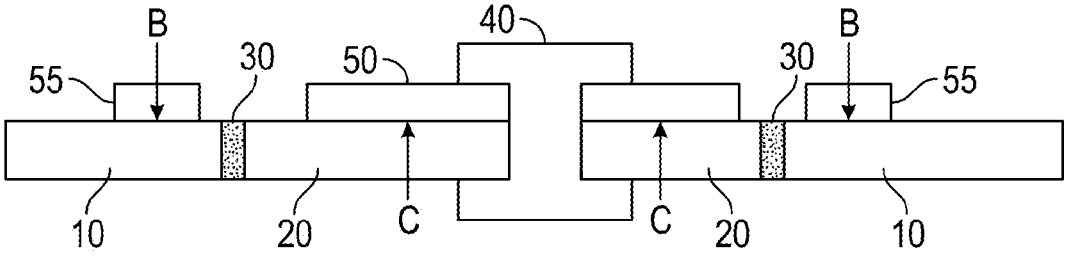
FIG. 3 is a cross-sectional diagram of a lid in accordance with one or more embodiments.

FIG. 3 is a cross-sectional diagram of lid 10 in FIG. 2 along line A-A in accordance with one or more embodiments. For simplicity, openings 56 are not shown. Panel 20 is defined by or bound by score line 30. Opening means 50 is attached to the lid via a rivet 40 driven through the panel 20. The arms 55 of the opening means apply pressure at or near the arrows labeled B, on the outside of the score line relative to the panel. In order to balance forces, forces at or near the arrows labeled C cause the panel 20 to begin to break away from the lid 10 along score line 30.

In various embodiments, an outer edge of the panel cover of the opening means can be a rolled edge such that the actual end of the material is folded under the panel cover and is adjacent to the top side of the adjacent lid. In such embodiments, as the opening means opens the panel, the panel can engage the rolled edge such that a sharp edge of the panel is covered or enveloped by the rolled edge of the panel cover.

Figure 4:
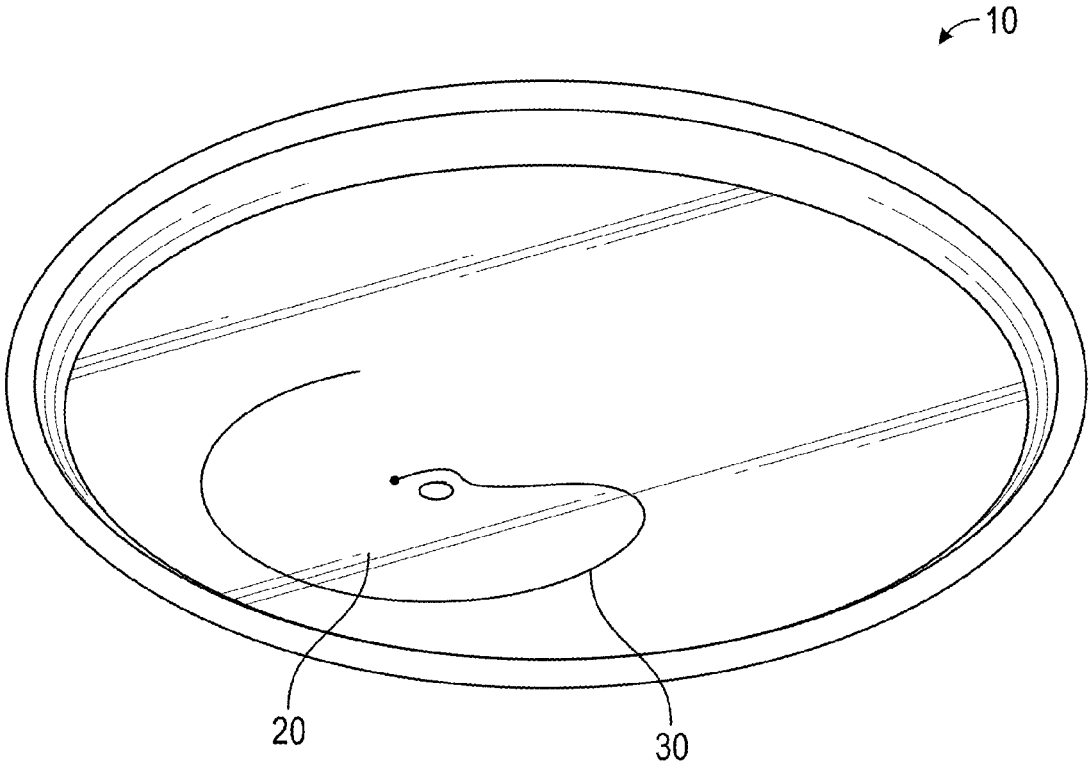
FIG. 4 is an illustration of a lid without the opening means in accordance with one or more embodiments.

FIG. 4 illustrates a lid without the opening means in accordance with one or more embodiments. In FIG. 4, lid 10 is illustrated as having a panel 20 outlined by a score line 30. The score line 30 may be of any desired shape. For example, in some embodiments, the score line is curved and substantially circular, oblong, oval, or tear-drop in shape with a narrower portion of the panel 20, if present, close to a center of the lid 10.

Figure 5:
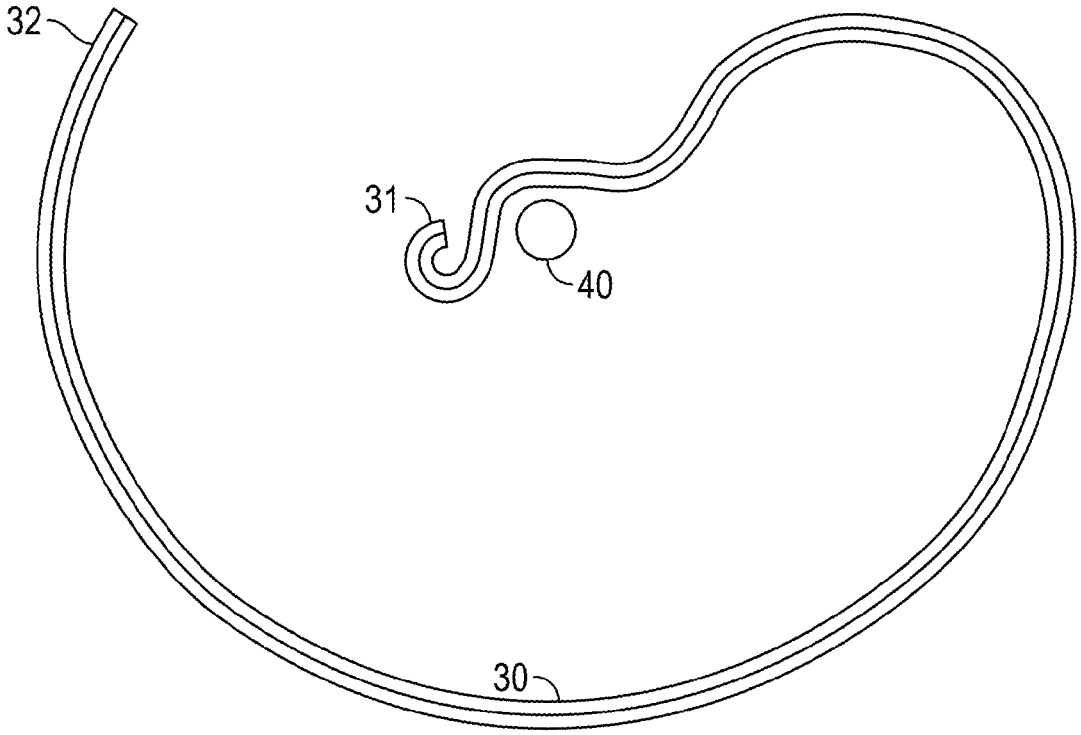
FIG. 5 is an illustration of a score line in accordance with one or more embodiments.

FIG. 5 is an illustration of an example embodiment of score line 30. As illustrated in the figures, the score line 30 has a first score line end 31 and a second score line end 32. The first score line end is substantially adjacent to a rivet 40 of the lid. In some embodiments, the first score line end has a semi-circular shape. Between the first score line end and the second score line end, the score line may curve around a portion of the rivet 40, then be directed towards an edge of the lid before circling around the rivet at a distance greater than at least twice the diameter of the rivet. The score line preferably does not form a substantially complete circle around the rivet, and thereby forms a boundary of the panel 20 of the lid.

When the panel is in a closed position, that is, the score line has not been broken and the lid is intact, the lever arm and the panel cover are adjacent to, substantially covering, and/or substantially contiguous to the panel. To operate the opening means, the lever arm is moved upward away from the lid to a position substantially perpendicular, relative to the lid, effective to press at least one of the one or more arms towards the lid. The one or more arms press on the lid outside the score line while the panel cover pulls the panel inside the score line, causing the score line to unseal the panel from the lid revealing a slight opening. In various embodiments, the slight opening is revealed along the narrow portion of the panel near the rivet.

The lever arm is pushed back towards its original position adjacent to the lid, pulling the panel cover and panel up and away from the plane of the lid and causing the score line to continue to unseal or break. As the score line unseals, an edge of the panel can rest adjacent to or situate within the rolled edge of the panel cover of the opening means.

Once the score line is substantially unsealed, the panel may be lifted upward relative to the lid in a direction toward the lever arm and hinged away from the opening created in the lid and exposing an internal face of the panel (e.g., a face that was internal to the can). The contents of the can may then be accessed through the opening.

In various embodiments, the panel can be embossed or printed with advertising or promotional information. For example, an advertisement, game code, trivia, or other content can be imprinted or marked on the internal face of the panel. When the can is opened and the internal face of the panel is exposed, the promotional content is visible to a consumer.

While various embodiments have been described, it is evident that many alternatives, modifications and variations will be apparent to those skilled in the art. Accordingly, the embodiments as set forth above are intended to be illustrative, not limiting. Various changes may be made without departing from the spirit and scope of the invention.

What is claimed is:

1. A pop-top for a can, the pop-top comprising:

a lid, the lid having a panel outlined via a score line (30); and an opening means attached to the panel at an attachment point, the opening means comprising a lever arm (52) and a panel cover (53), the panel cover (53) having an outer edge that extends over a portion of the lid that is adjacent to and contiguous with the score line (30) outlining the panel, the opening means configured to apply a force to the lid effective to cause the score line (30) to break and the panel to lift away from the lid in a direction toward the lever arm (52);

wherein the panel cover (53) of the opening means is at least partially semi-circular in shape and shaped to correspond to a majority of the overall shape of the panel of the lid and is sized to be larger than the overall shape of the panel;

wherein the panel cover (53) is configured to apply pressure to the lid outside the score line (30) when the opening means is utilized;

wherein the score line (30) has a first score line end and a second score line end and wherein the first score line end is adjacent to an attachment point of the panel; wherein between the first score line end and the second score line end, the score line (30) is formed behind closer to a center of the lid and around the attachment point and then towards an edge of the lid, then curving in a semi-circular shape toward an opposite lateral side of the lid and thereby forms a boundary of the panel;

wherein the score line (30), once unsealed by the lever arm (52) raising the attachment point of the panel pivoting about the panel cover (53) contact with the lid outside of the boundary of the panel, allows the panel to be lifted upward relative to the lid in a direction toward the lever arm (52) and hinged away from the opening created in the lid and thereby exposing an internal face of the panel; and wherein the opening means comprises a second class lever with the panel cover (53) serving as a fulcrum at one end, the lever arm (52) distally presented at a manually-moved opposite end, and the attachment point to the opening means being between the fulcrum and the manually-moved opposite end presenting resistance that results in a shearing of the lid along the score line (30) between the attachment point and the manually-moved opposite end.

2. The pop-top of claim 1, the attachment point comprising a rivet configured to attach the opening means to the lid.

3. The pop-top of claim 1, wherein the panel cover (53) comprises one or more panel cover arms (55) parallel to the elongated parallel sides of the lever arm (52) that are configured to apply pressure to the lid rather than the panel of the lid when the opening means is engaged.

4. The pop-top of claim 3, wherein the panel cover (53) further comprises one or more arms (55) that extend outside of the score line.

5. The pop-top of claim 4, wherein each of the one or more arms (55) of the panel cover (53) is separated from the adjacent elongated side of the lever arm (52) by a bend relief portion.

6. The pop-top of claim 3, wherein the panel cover (53) is substantially planar and includes one or more openings.

7. The pop-top of claim 1, the panel comprising an outer face adjacent to the opening means and an inner face, wherein the inner face of the panel includes an advertisement or promotional information thereon.

8. The pop-top of claim 1, the opening means further comprising one or more openings effective to reduce stress near a rivet opening in the opening means.

9. The pop-top of claim 1, the panel cover (53) comprising a rolled edge, the rolled edge configured to envelope an edge of the panel.

10. A method of opening a pop-top can comprising:

providing an opening means attached to a lid of the pop-top can, the opening means comprising a lever arm (52), a panel cover (53), and one or more arms (55), the panel cover (53) having an outer edge that extends over a portion of the lid that is adjacent to a panel defined by a score line (30) in the lid;

wherein the opening means comprises a second class lever with the panel cover (53) serving as a fulcrum at one end, the (52) distally presented at a manually-moved opposite end, and the attachment point to the opening means being between the fulcrum and the manually-moved opposite end presenting resistance that results in a shearing of the lid along the score line (30) between the attachment point and the manually-moved opposite end;

wherein each of the lever arms (52) is configured to apply pressure to the lid outside the score line (30) when the opening means is utilized;

wherein when the panel is in a closed position and the score line has not been broken, the lever arm (52) and the panel cover (53) are adjacent to and substantially contiguous to the panel;

lifting the lever arm (52) to a position perpendicular relative to the lid effective to press the one or more arms (55) of the opening means down on the lid outside the score line;

continuing to lift the lever arm (52) to cause the lever arm (52) to fold forward towards the panel raising the attachment effective to cause the score line behind closer to a center of the lid and around the attachment point to break and create an opening between the panel and the lid; and pushing the lever arm (52) back towards the lid in a direction opposite from a direction in which the lever arm (52) was lifted effective to pull the panel cover (53) and the panel up and away from a plane in which the lid lies and to expand the opening along the score line.

11. The method of claim 10, the opening means further comprising one or more openings configured to reduce stress near a rivet opening in the opening means.

12. The method of claim 10, the panel cover (53) having a rolled edge, wherein as the score line breaks, an edge of the panel is enveloped by the rolled edge.

13. The method of claim 10, pushing the lever arm (52) back towards the lid comprising pushing the lever arm (52) back towards the lid effective to cause an internal face of the panel to be exposed, the internal face of the panel comprising promotional content, wherein the promotional content comprises one or more of an advertisement, a game code, or trivia.

14. A method of opening a pop-top can comprising:

providing the pop-top of claim 1;

lifting the lever arm (52) effective to cause the lever arm (52) to fold forward towards the panel effective to cause the score line (30) to break and create an opening between the panel and the lid; and pushing the lever arm (52) back towards the lid in a direction opposite from a direction in which the lever arm (52) was lifted effective to pull the panel cover (53) and the panel up and away from a plane in which the lid lies and to expand the opening along the score line.

15. The method of claim 14, the opening means further comprising one or more openings configured to reduce stress near a rivet opening in the opening means.

16. The method of claim 14, the panel cover (53) having a rolled edge, wherein as the score line breaks, an edge of the panel is enveloped by the rolled edge.

17. The method of claim 14, pushing the lever arm (52) back towards the lid comprising pushing the lever arm (52) back towards the lid effective to cause an internal face of the panel to be exposed, the internal face of the panel comprising promotional content, wherein the promotional content comprises one or more of an advertisement, a game code, or trivia.

* * * * *